US008922102B2

(12) United States Patent
Camilli

(10) Patent No.: US 8,922,102 B2
(45) Date of Patent: Dec. 30, 2014

(54) COMPOSITE SPARK PLUG

(75) Inventor: Louis S. Camilli, Albuquerque, NM (US)

(73) Assignee: Enerpulse, Inc., Albuquerque, NM (US)

( * ) Notice: Subject to any disclaimer, the term of this patent is extended or adjusted under 35 U.S.C. 154(b) by 300 days.

(21) Appl. No.: 11/747,714

(22) Filed: May 11, 2007

(65) Prior Publication Data

US 2007/0262721 A1 Nov. 15, 2007

Related U.S. Application Data

(60) Provisional application No. 60/799,926, filed on May 12, 2006.

(51) Int. Cl.

| | |
|---|---|
| ***H01T 13/22*** | (2006.01) |
| ***H01T 13/34*** | (2006.01) |
| ***H01T 13/40*** | (2006.01) |
| *H01T 21/02* | (2006.01) |

(52) U.S. Cl.

CPC ..... *H01T 13/40* (2013.01); *H01T 21/02* (2013.01)

USPC ..... 313/137; 313/135

(58) Field of Classification Search

CPC ..... H01T 13/22; H01T 13/34; H01T 13/38; H01T 13/40

USPC ..... 313/118–145; 123/32, 41, 169 EL, 123/169 R, 310, 596; 315/58–61

See application file for complete search history.

(56) References Cited

U.S. PATENT DOCUMENTS

| | | | | |
|---|---|---|---|---|
| 2,391,458 | A | 12/1945 | Hensel | |
| 2,908,569 | A * | 10/1959 | Peras | 419/39 |
| 3,267,325 | A | 8/1966 | Why | |
| 3,581,141 | A | 5/1971 | Beaubier | |
| 3,599,030 | A | 8/1971 | Armstrong | |
| 3,603,835 | A * | 9/1971 | Eaton | 313/118 |
| 3,683,232 | A * | 8/1972 | Baur | 315/58 |
| 3,790,842 | A * | 2/1974 | Westenkirchner et al. | 313/118 |
| 3,831,562 | A | 8/1974 | Paxton et al. | |
| 4,082,976 | A * | 4/1978 | Lentz | 313/135 |

(Continued)

FOREIGN PATENT DOCUMENTS

| | | |
|---|---|---|
| CN | 1150348 | 5/1997 |
| CN | 1254972 | 5/2000 |

(Continued)

*Primary Examiner* — Nimeshkumar Patel

*Assistant Examiner* — Steven Horikoshi

(74) *Attorney, Agent, or Firm* — Jeffrey D. Myers; Justin R. Jackson; Peacock Myers, P.C.

(57) ABSTRACT

A composite ignition device includes a positive electrode having a tip formed thereon that is bonded to a first insulator to form a firing cone assembly. A second insulator having a negative capacitive element embedded therein is attached to the firing cone assembly. A positive capacitive element is disposed in the second insulator and is separated from the negative capacitive element by the second insulator. The positive capacitive element is coupled to the positive electrode. The positive and negative capacitive elements form a capacitor. A resistor is coupled to the positive capacitive element. An electrical connector is coupled to the resistor and attached to the second insulator. A shell including a negative electrode having a tip is attached to the second insulator and the firing core assembly and coupled to the negative capacitive element. The negative electrode tip is spaced apart from the positive electrode tip.

25 Claims, 4 Drawing Sheets

(56) References Cited

U.S. PATENT DOCUMENTS

| | | | | | |
|---|---|---|---|---|---|
| 4,093,887 | A * | 6/1978 | Corbach et al. | 313/140 |
| 4,419,539 | A * | 12/1983 | Arrigoni | 178/18.09 |
| 4,460,847 | A | 7/1984 | Englehardt | |
| 4,568,855 | A | 2/1986 | Nemeth et al. | |
| 4,613,789 | A | 9/1986 | Herden et al. | |
| 4,746,834 | A | 5/1988 | Bauerle et al. | |
| 4,841,925 | A * | 6/1989 | Ward | 123/143 B |
| 4,914,344 | A | 4/1990 | Watanabe et al. | |
| 4,952,837 | A | 8/1990 | Matsumura et al. | |
| 5,028,747 | A | 7/1991 | Ballentine et al. | |
| 5,049,786 | A | 9/1991 | Gotisar et al. | |
| 5,095,242 | A | 3/1992 | Richeson | |
| 5,187,404 | A | 2/1993 | Straub | |
| 5,210,458 | A | 5/1993 | McDougal | |
| 5,304,894 | A | 4/1994 | Stimson | |
| 5,371,436 | A * | 12/1994 | Griswold et al. | 315/58 |
| 5,514,314 | A * | 5/1996 | McDougal | 264/615 |
| 5,514,929 | A * | 5/1996 | Kawamura | 313/141 |
| 5,751,096 | A * | 5/1998 | Lahens | 313/141 |
| 6,095,124 | A * | 8/2000 | Matsubara et al. | 123/594 |
| 6,130,498 | A | 10/2000 | Shimizu et al. | |
| 6,132,277 | A * | 10/2000 | Tribble et al. | 445/7 |
| 6,208,066 | B1 * | 3/2001 | Kokubu et al. | 313/141 |
| 6,329,743 | B1 * | 12/2001 | Camilli | 313/141 |
| 6,341,501 | B2 | 1/2002 | Sugimoto et al. | |
| 6,517,931 | B1 | 2/2003 | Fu | |
| 6,559,578 | B1 * | 5/2003 | Herden et al. | 313/136 |
| 6,647,794 | B1 | 11/2003 | Nelson et al. | |
| 6,864,623 | B2 | 3/2005 | Ishikawa | |
| 7,019,448 | B2 | 3/2006 | McMurray et al. | |
| 8,278,808 | B2 | 10/2012 | Lykowski | |
| 8,672,721 | B2 | 3/2014 | Camilli | |
| 2001/0040089 | A1 | 11/2001 | Hemingway et al. | |
| 2004/0239223 | A1 | 12/2004 | Watanabe | |
| 2005/0110382 | A1 * | 5/2005 | Walker, Jr. | 313/143 |
| 2005/0168121 | A1 | 8/2005 | Tinwell | |
| 2006/0220510 | A1 | 10/2006 | Shibata | |
| 2007/0116976 | A1 * | 5/2007 | Tan et al. | 428/546 |

FOREIGN PATENT DOCUMENTS

| | | | |
|---|---|---|---|
| CN | 2398751 | Y | 9/2000 |
| EP | 0118789 | | 2/1984 |
| EP | 0287080 | | 10/1988 |
| EP | 0302474 | | 2/1989 |
| EP | 1 320 159 | A1 | 6/2003 |
| EP | 1 701 419 | A1 | 9/2006 |
| GB | 937646 | | 9/1963 |
| JP | 56-88280 | | 7/1981 |
| JP | 61-258970 | | 11/1986 |
| JP | 62-503134 | | 12/1987 |
| JP | 1987-503134 | | 12/1987 |
| JP | 04-133281 | | 5/1992 |
| JP | 07-037673 | | 2/1995 |
| JP | 10-022050 | | 1/1998 |
| JP | 11-185929 | | 7/1999 |
| JP | 2000-046628 | | 2/2000 |
| JP | 2000-252039 | | 9/2000 |
| JP | 2001-335360 | | 12/2001 |
| JP | 2003-187944 | | 6/2003 |
| JP | 2004-319335 | | 11/2004 |
| JP | 2007-512662 | | 5/2007 |
| JP | 2009-527078 | | 7/2009 |
| JP | 2010-212245 | | 9/2010 |

* cited by examiner

COMPOSITE SPARK PLUG

CROSS-REFERENCE TO RELATED APPLICATIONS

This application claims priority to and the benefit of the filing of U.S. Provisional Patent Application Ser. No. 60/799,926, entitled "Composite Spark Plug", filed on May 12, 2006, and the specification thereof is incorporated herein by reference.

BACKGROUND OF THE INVENTION

The present invention relates to spark plugs used to ignite fuel in internal combustion spark—ignited engines. Present day spark plug technology dates back to the early 1950's with no dramatic changes in design except for materials and configuration of the spark gap electrodes. These relatively new electrode materials such as platinum and iridium have been incorporated into the design to mitigate the erosion common to all spark plugs electrodes in an attempt to extend the useful life. While these materials will reduce electrode erosion for typical low power discharge (less than 1 ampere peak discharge current) spark plugs and perform to requirements for $10^9$ cycles, they will not withstand the high coulomb transfer of high power discharge (greater than 1 ampere peak discharge current). Additionally, there have been many attempts at creating higher capacitance in the spark plug or attaching a capacitor in parallel to existing spark plugs. While this will increase the discharge power of the spark, the designs are inefficient, complex and none deal with the accelerated erosion associated with high power discharge. There has been no attempt to create an insulator of the spark plug using dissimilar materials in a modular assembly.

U.S. Pat. No. 3,683,232, U.S. Pat. No. 1,148,106 and U.S. Pat. No. 4,751,430 discuss employing a capacitor or condenser to increase spark power. There is no disclosure as to the electrical size of the capacitor, which would determine the power of the discharge. Additionally, if the capacitor is of large enough capacitance, the voltage drop between the ignition transformer output and the spark gap could prevent gap ionization and spark creation.

U.S. Pat. No. 4,549,114 claims to increase the energy of the main spark gap by incorporating into the body of the spark plug an auxiliary gap. The use of two spark gaps in a singular spark plug to ignite fuel in any internal combustion spark ignited engine that utilizes electronic processing to control fuel delivery and spark timing could prove fatal to the operation of the engine as the EMI/RFI emitted by the two spark gaps could cause the central processing unit to malfunction.

In U.S. Pat. No. 5,272,415, a capacitor is disclosed attached to a non-resistor spark plug. Capacitance is not disclosed and nowhere is there any mention of the electromagnetic and radio frequency interference created by the non-resistor spark plug, which if not properly shielded against EMI/RFI emissions, could cause the central processing unit to shut down or even cause permanent damage.

U.S. Pat. No. 5,514,314 discloses an increase in size of the spark by implementing a magnetic field in the area of the positive and negative electrodes of the spark plug. The invention also claims to create monolithic electrodes, integrated coils and capacitors but does not disclose the resistivity values of the monolithic conductive paths creating the various electrical componentry. Electrical components conductive paths are designed for resistivity values of 1.5-1.9 ohms/meter ensuring proper function. Any degradation of the paths by migration of the ceramic material inherent in the cermet ink reduces the efficacy and operation of the electrical device. In addition, there is also no mention of the voltage hold-off of the insulating medium separating oppositely charged conductive paths of the monolithic components. If standard ceramic material such as Alumina 86% is used for the spark plug insulating body, the dielectric strength, or voltage hold off is 200 volts/mil. The standard operating voltage spread for spark plugs in internal combustion spark ignited engines is from 5 Kv to 20 Kv with peaks of 40 Kv seen in late model automotive ignitions, which might not insulate the monolithic electrodes, integrated coils and capacitors against this level of voltage.

U.S. Pat. No. 5,866,972 and U.S. Pat. No. 6,533,629 speak to the application, by various methods and means, electrodes and or electrode tips consisting of platinum, iridium or other noble metals to resist the wear associated with spark plug operation. These applications are likely not sufficient to resist the electrode wear associated with high power discharge. As the electrode wears, the voltage required to ionize the spark gap and create a spark increases. The ignition transformer or coil is limited in the amount of voltage delivered to the spark plug. The increase in spark gap due to accelerated erosion and wear could be more than the voltage available from the transformer, which could result in misfire and catalytic converter damage.

U.S. Pat. No. 6,771,009 discloses a method of preventing flashover of the spark and does not resolve issues related to electrode wear or increasing spark discharge power.

U.S. Pat. No. 6,798,125 speaks to the use of a higher heat resistance Ni-alloy as the base electrode material to which a noble metal is attached by welding. The primary claim is the Ni-based base electrode material, which ensures the integrity of the weld. The combination is said to reduce electrode erosion but does not claim to either reduce erosion in a high-power discharge condition or improve spark power.

U.S. Pat. No. 6,819,030 for a spark plug claims to reduce ground electrode temperatures but does not claim to reduce electrode erosion or improve spark power.

BRIEF SUMMARY OF THE INVENTION

A composite ignition device for an internal combustion engine of the present invention includes a positive electrode having a tip formed on an end thereof that is bonded to a first insulator to form a firing cone assembly. The ignition device includes a second insulator including a negative capacitive element embedded therein attached to the firing cone assembly. A positive capacitive element is disposed in the second insulator and is separated from the negative capacitive element by the second insulator. The positive capacitive element and the negative capacitive element form a capacitor. The positive capacitance element and the negative capacitive element form a capacitor. A resistor disposed in a resistor insulator is coupled to the positive capacitive element by a resistor connector. An electrical connector is coupled to the resistor and attached to the second insulator and a shell is attached to the second insulator and the firing core assembly and coupled to the negative capacitive element. The shell includes a negative electrode having a tip formed thereon and spaced apart from the positive electrode tip.

Alternatively, the second insulator is attached to the firing cone assembly and the negative capacitive element is embedded in the second insulator by injection molding or by insert molding. Alternatively, the second insulator comprises an engineered polymer. The engineered polymer may comprise liquid crystal polymer or polyetheretherketone and may have a dielectric constant from between about 5 to about 10.

Alternatively, the first insulator comprises an alumina material. The alumina material may comprise from about 88 percent to about 99 percent pure alumina. Alternatively, the resistor connector comprises a spring member. Alternatively, the positive and negative electrode tips comprise a sintered rhenium and tungsten material. The material may be formed from about 50 percent rhenium and about 50 percent tungsten or from about 75 percent rhenium and about 25 percent tungsten. Alternatively, the positive electrode further comprises a coating of conductive ink on an exterior surface thereof, the coating having a predetermined thickness. The conductive ink may comprise a precious metal or precious metal alloy. Alternatively, the capacitor has a predetermined capacitance in the range from about 30 to about 100 pf. Alternatively, the positive capacitive element is coupled to the positive electrode by an interference fit.

In another embodiment, the present invention provides a circuit for an ignition device for an internal combustion engine that includes a power source operable to intermittently activate the circuit, a positive electrode having a tip on an end thereof, and a ground electrode connected to ground and having a tip on an end thereof. The ground electrode tip is spaced apart from the positive electrode tip by a predetermined spark gap. The circuit also includes at least one resistor connected in series with the power source and the positive electrode and at least one capacitor directly connected to the resistor and connected in parallel with the positive electrode and ground.

Alternatively, the at least one resistor reduces radio frequency interference (RFI) when the circuit is active. Alternatively, the at least one capacitor increases peak current to the spark gap when the circuit is active. Alternatively, the positive and negative electrode tips comprise a sintered rhenium and tungsten material. The material may be formed from about 50 percent rhenium and about 50 percent tungsten or from about 75 percent rhenium and about 25 percent tungsten. Alternatively, the resistor has a predetermined resistance in the range from about 2 kohms to about 20 kohms. Alternatively, the capacitor has a predetermined capacitance in the range from about 30 to about 100 pf.

In another embodiment, the present invention provides a method for forming a composite ignition device for an internal combustion engine that includes bonding a positive electrode including a tip formed thereon with a first insulator to form a firing cone assembly, embedding a negative capacitive element in a second insulator and attaching the second insulator to the firing cone assembly, and coupling a positive capacitive element to the positive electrode in the second insulator. The positive capacitive element is separated from the negative capacitive element by the second insulator and the positive capacitance element and the negative capacitive element form a capacitor. The method also includes disposing a resistor in a resistor insulator, coupling the resistor to the positive capacitive element by a resistor connector, coupling an electrical connector to the resistor, attaching the electrical connector to the second insulator, attaching a shell to the second insulator and the firing cone assembly and coupling the shell to the negative capacitive element. The shell includes a negative electrode having a tip formed thereon, the negative electrode tip being spaced apart from the positive electrode tip.

Alternatively, the method further comprises sealing a top of the electrode in the insulator. Alternatively, the method further comprises coating the positive electrode with a conductive ink prior to bonding the positive electrode with the first insulator. The conductive ink may comprise a precious metal or precious metal alloy. Alternatively, the step of attaching the she to the second insulator and the firing cone assembly comprises crimping the shell to the second insulator and the firing cone assembly. Alternatively, the step of coupling the shell to the negative capacitive element comprises crimping the shell to the negative capacitive element.

Alternatively, the step of bonding the positive electrode with the first insulator comprises heating the positive electrode and the first insulator at a predetermined temperature for a predetermined time. The predetermined temperature may be about 750 degrees Celsius to about 900 degrees Celsius and the predetermined time may be about 10 minutes to about 60 minutes.

Alternatively, the step of embedding a negative capacitive element in a second insulator and attaching the second insulator to the firing cone assembly comprises injection molding or insert molding. Alternatively, the second insulator comprises an engineered polymer. The engineered polymer may comprise liquid crystal polymer or polyetheretherketone and may have a dielectric constant from between about 5 to about 10.

Alternatively, the first insulator comprises an alumina material. The alumina material may comprise from about 88 percent to about 99 percent pure alumina. Alternatively, the resistor connector comprises a spring member. Alternatively, resistor connector comprises a spring member. Alternatively, the method further comprises forming the positive and negative electrode tips by sintering rhenium and tungsten to form a sintered material. The material may be formed from about 50 percent rhenium and about 50 percent tungsten or from about 75 percent rhenium and about 25 percent tungsten. Alternatively, the capacitor has a predetermined capacitance in the range from about 30 to about 100 pf. Alternatively, the step of coupling to the positive electrode the positive capacitive element is performed by an interference fit.

The present invention provides an ignition device or spark plug for spark ignited internal combustion engines which, comprises a capacitive element or capacitor formed with or integral to the insulator for the purpose of peaking the electrical current and thereby electrical power of the spark during the streamer phase of the spark event. The additional increase in spark power creates a larger flame kernel and ensures consistent ignition relative to crank angle, cycle-to-cycle. With circuitry properly employed, there is no change to the breakdown voltage of the spark gap, no change to the timing of the spark event, nor is there any change to total spark duration.

In operation, the ignition pulse is exposed to the spark gap and the capacitor of the spark plug simultaneously as the capacitor is connected in parallel to the circuit. As the coil rises inductively in voltage to overcome the resistance in the spark gap, energy is stored in the capacitor as the resistance in the capacitor is less than the resistance in the spark gap. Once resistance is overcome in the spark gap through ionization, there is a reversal in resistance between the spark gap and the capacitor triggering the capacitor to discharge the stored energy very quickly, between one to ten nanoseconds, across the spark gap peaking the current and thereby the power of the spark.

The capacitor charges to the voltage level required to breakdown the spark gap. As engine load increases, vacuum decreases, increasing the air pressure at the spark gap. As pressure increases the voltage required to break down the spark gap increases causing the capacitor to charge to a higher voltage. The resulting discharge is peaked to a higher power value. There is no delay in the timing event as the capacitor is charging simultaneously with the rise in voltage of the coil.

The capacitive elements preferably comprise two oppositely charged, electrically conductive cylindrical plates, of which the ground plate is completely encased in an engineered polymer during an insert or over molding process. The negative plate is exposed in a small circumferential area at the major diameter of the composite insulator making contact with the conductive steel shell of the spark plug. This exposure allows physical, mechanical and electrical contact thereby effectively placing the plate in the ground circuit of the electrical system.

The positive plate of the capacitive element is also the center conductor of the spark plug connected, through a resistor or inductor, to the high-tension lead from the ignition coil or the coil directly. The conductor is inserted, with an interference fit, into the central cavity of the composite insulator formed during the molding process. An interference fit of 0.0005"-0.001" is preferably required to fix the relationship of the conductive plates, thereby establishing a consistent capacitance value. The insertion of the center conductor also establishes electrical and mechanical contact with the center electrode of the spark gap.

The molding process, using the engineered polymer, aligns and secures the ceramic combustion cone, which contains the center electrode of the spark gap to the negative plate of the capacitive element of the spark plug. Preferably, the molding process is an injection molding process or an insert molding process, as will be appreciated by those skilled in the art. Inserting the center conductor completes the capacitor and provides a connection between the spark plug and the ignition coil. Capacitance can vary from 10 picofarads to as much as 100 picofarads dependant on the geometry of the plates, their separation and the dielectric constant of the insulating engineered polymer.

The ends of capacitor plates are preferably offset to prevent enhancing the electrical field at the termination of the plates, which could compromise the dielectric strength of the engineered polymer insulator and could result in catastrophic failure of the spark plug. The electrical charge of the ignition could break down the insulator at this point with the pulse going directly to ground, bypassing the spark gap and causing permanent spark plug failure.

The present invention also provides a spark plug for spark ignited internal combustion engines, which provides an electrode material comprised primarily of Rhenium sintered with Tungsten. Sintered compound percentages can range from 50% Rhenium and 50% Tungsten to 75% Rhenium and 25% Tungsten. Pure Tungsten would be a very desirable electrode material due to its conductivity and density but is not a good choice for internal combustion engine applications as it oxidizes at temperatures lower than the combustion temperatures of fossil fuels. Additionally, newer engine design is employing lean burn, which has a higher combustion temperature making Tungsten an even less acceptable electrode material. During the oxidation process the Tungsten electrode will erode at an accelerated rate due to its volatility at oxidation temperature, thereby reducing useful life. By sintering tungsten with rhenium protects tungsten against the oxidation process and allows for the desired effect of reducing erosion in a high-power discharge application Using noble metals for electrodes, as is current industry practice to meet federal guidelines, will not survive the required mileage requirement under high spark power operation. The increased power of the discharge will increase the erosion rate of the noble metal electrode and cause misfire. In all cases of misfire, damage or destruction of the catalytic converter will occur.

While the use of the rhenium/tungsten sintered compound will mitigate the oxidation erosion issue, the very high power of the spark discharge will still erode the electrode at a much faster rate than conventional ignition. Electrode placement in the insulator, fully embedded in the insulator with just the extreme end and only the face of the electrode exposed, takes advantage of a spark phenomena described as electron creep. When the electrode embedded in the insulator is new, spark occurs directly between the embedded electrode and the rhenium/tungsten tip or button attached to the ground strap of the negative electrode. As the embedded electrode erodes from use under high power discharge, the electrode will begin to draw or erode away from the surface of the insulator. In this condition, electrons from the ignition pulse will emanate from the positive electrode and creep up the side of the exposed electrode cavity, jumping to the negative electrode once ionization occurs and creating a spark.

The voltage required for electrons to creep along, or ionize, the inside surface of the electrode cavity is very small. This design allows the electrode to erode beyond operational limits of the ignition system but maintain the breakdown voltage of a much smaller gap between the electrodes. In this fashion, the larger gap, eroded from sustained operation under high power discharge, performs like the original gap in the sense that voltage levels are not increased beyond the output voltage of the ignition system thereby preventing misfire for the required mileage.

The invention also provides a mechanism by which high power discharge is effected and radio frequency interference, generally associated with high power discharge, is suppressed. Utilizing a capacitor that is connected in parallel across the spark gap to charge to the breakdown voltage of the spark gap and then discharge very quickly during the streamer phase of the spark, will increase the power of the ignition spark exponentially as compared to the spark power of conventional ignition. The primary reason for this is the total resistance in the secondary circuit of the ignition.

Advances have been made in the secondary circuit of the ignition by eliminating the high voltage transmission lines between the coil and the spark plug, and by utilizing one coil per cylinder allowing for greater electrical transfer efficiency. However, there still exists significant resistance in the spark plug, which brings the transfer efficiency of the typical automotive ignition below 1%. By replacing the resistor spark plug with one of zero resistance, electrical transfer efficiency of ignition energy rises to approximately 10%. The addition of an appropriately sized capacitor further elevates the transfer efficiency to over 50%. The greater the electrical transfer efficiency, the greater the amount of ignition energy coupled to the fuel charge, the greater the combustion efficiency, which likely requires the use of a non-resistor spark plug to enable the very high transfer efficiency. The use of a non-resistor plug, however, produces radio frequency and electromagnetic interference (RFI), which is magnified by the very hard discharge of the capacitor. This is unacceptable because RFI at these levels and frequencies is incompatible with the operation of automotive computers, which is why resistor spark plugs are universally used by the original equipment manufacturers.

The present invention also provides a circuit that includes a preferably 5KΩ resistor that will suppress any high frequency electrical noise while not affecting the high power discharge. Critical to the suppression of RFI is the placement of the resistor in proximity to the capacitor within the secondary circuit of the ignition system. One end of the resistor is connected directly to the capacitor with the other end connected directly to the terminal, which connects to the coil in a coil-on-plug application or to the high voltage cable from the coil. In this way the driver-load circuit has been isolated from any resistance, the driver now being the capacitor and the load being the spark gap. Once discharged, the coil pulse bypasses the capacitor and goes directly to the spark gap, as the resistance in the capacitor is greater than the resistance of the spark gap. This placement allows for the entirety of the high voltage pulse to pass through the spark gap unaffecting spark duration.

The present invention also provides a connection of the negative capacitor plate to the ground circuit. Any inductance or resistance in the capacitor connections will reduce the efficacy of the discharge resulting in reduced energy being coupled to the fuel charge. During the molding process a circumferential ring of the cylindrical plate at the major diameter of the insulator is left exposed. The ring makes positive mechanical and electrical contact with the shell of the spark plug. The metal conductive shell is provided with appropriate threads to allow installation into the head of the internal combustion engine. As the head is mechanically attached to the engine block, and the engine block is connected to the negative terminal of the battery by means of a grounding strap, grounding of the negative plate of the capacitor is advantageously accomplished by the positive mechanical contact to the spark plug shell.

The present invention also provides a connection to the positive plate of the capacitor providing a resistance free path from the ignition pulse to the center, positive electrode of the spark gap. This is accomplished by utilizing the center conductor of the spark plug as the positive plate. The center conductor, preferably constructed of a tubular highly conductive material such as aluminum or copper, is inserted into the central cavity of the insulator using an interference fit and engages the extension of the positive electrode upon full insertion.

The present invention also provides a positive gas seal for the internal components of the spark plug against gasses and pressures resulting from the combustion process. The ceramic cone of the insulator exposed to the combustion chamber is provided with a center cone into which the center electrode is positioned. The electrode is provided with an extension opposite the end exposed to the combustion chamber for engagement with the center conductor and positive plate of the capacitor. At the base of this extension is a circular boss or flange fitting into the ceramic cone that allows the electrode to be sealed against combustion gasses using a ceramic epoxy, copper glass frit or other suitable high temperature sealant.

BRIEF DESCRIPTION OF THE SEVERAL VIEWS OF THE DRAWINGS

The objects and features of the present invention will become clearer from the following description of the preferred embodiments given with reference to the attached drawings, wherein.

DETAILED DESCRIPTION OF THE INVENTION

Figure 1:
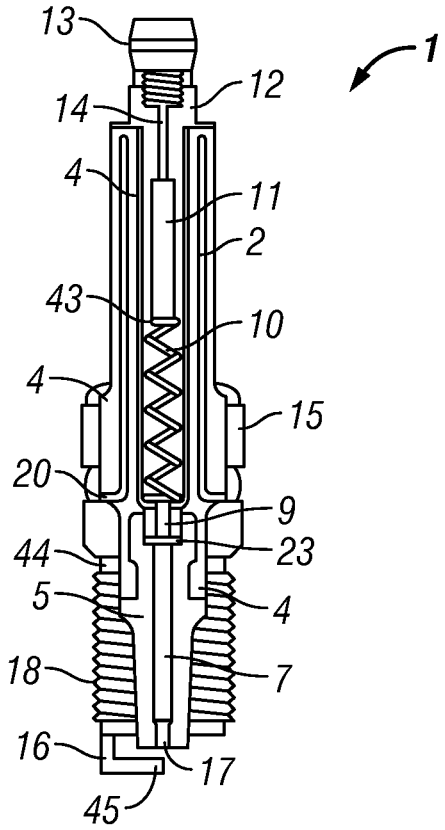
FIG. 1 is a cross sectional view of an embodiment of an ignition device for internal combustion spark ignited engines of the present invention.

Referring now to the drawings, in particular FIG. 1, a spark plug or ignition device for spark ignited, internal combustion engines in accordance with the present invention is shown generally as 1. The spark plug or ignition device 1 consists of a preferably metal casing or shell 15 having a substantially cylindrical base 44, which may have external threads 18, formed thereon for engagement with the cylinder head (not shown) of the spark ignited internal combustion engine (not shown). The cylindrical base 44 of the spark plug shell has a generally flattened surface perpendicular to the longitudinal axis of the spark plug 1 to which a ground electrode 16 is affixed, preferably by conventional welding. In an embodiment of the invention, the ground electrode 16 has a preferably rounded tip 45 of Rhenium/Tungsten sintered compound, which resists the erosion of the electrode 16 due to high power discharge, as further disclosed herein.

The spark plug or ignition device 1 includes a preferably hollow, composite insulator 4 disposed concentrically within the shell 15, incorporating a combustion cone 5, preferably formed from ceramic or the like. The center or positive electrode 7 is disposed concentrically within the ceramic cone 5 that is disposed in the combustion chamber when installed in the engine (not shown).

The center electrode 7 is preferably constructed of a thermally and electrically conductive material with very low resistivity values such as, but not limited to, a copper or copper alloy, with or without an outer coating, cladding or plating preferred in a nickel alloy. The center electrode 7 preferably includes formed thereon, by weldment or by other suitable attachment, an electrode tip 17 preferably constructed of a Rhenium/Tungsten alloy (50%-75% Rhenium), which is highly resistant to erosion under high power discharge, as further disclosed herein.

The spark plug 1 includes a highly conductive spring 10 that is a component of the center conductor assembly and positive plate 43 of the capacitive element. The spring 10 is connected to one end of a preferably 5KΩ (or suitable resistance) resistor or inductor 11 and electrically and mechanically contacts the positive plate 43 of the capacitor, which is connected to the center electrode 7 by means of an interference fit of the stud 9 of the electrode 7 into the positive plate 43. Preferably, the resistor or inductor 11 is connected to a high voltage terminal 13 for further connection to an ignition coil (not shown) by a penetrating rod 14 of the terminal 13, as further disclosed herein.

The composite insulator 4 of the spark plug is inserted into the shell 15 and preferably crimped for positive alignment and seal against combustion gasses, as is customary practice in the industry. Preferably, during an over molding process of creating the insulator 4, a flange 3 of a negative plate 2 is left exposed. The exposed flange 3 of the negative plate of the capacitor 2 makes physical and electrical contact with the conductive shell 15 of the spark plug when the shell 15 is crimped with sideward and downward pressure onto the insulator 4 using conventional industry practice. The mechanical contact between the shell 15, which is electrically connected to the ground circuit of the engine ignition circuit and the negative plate 2 of the capacitor advantageously ensures that the negative plate 2 is electrically connected to the ground circuit of the ignition system.

Figure 2A:
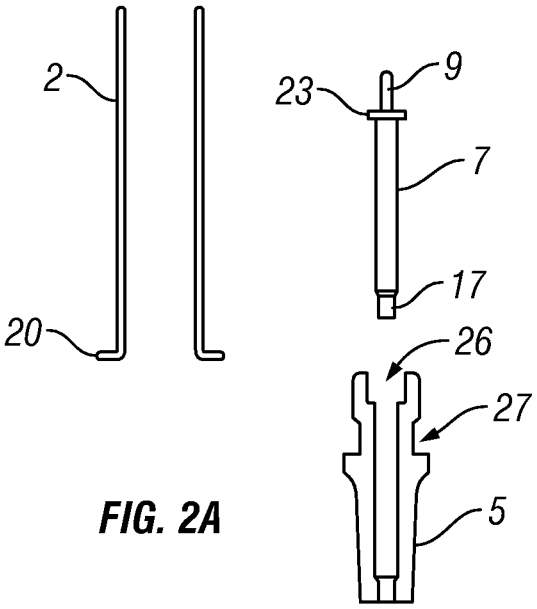
FIG. 2A is a partially exploded cross sectional view of the individual components that are over-molded with the engineered polymer to create the insulator of the spark plug.
Figure 2B:
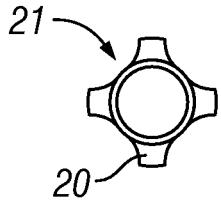
FIG. 2B is a top view of the capacitive element shown in FIG. 2A.

Referring now to FIG. 2, the negative plate is shown generally at 2 and includes at least one flange 20 extending therefrom. During the molding process, the negative plate 2 is encased in the engineered polymer of the insulator 4 and the tips of flange 20 are left exposed in order that they make mechanical and electrical contact with the shell of the spark plug (not shown) thereby ensuring the plate 2 is electrically connected to the ground of the ignition system. A scallop 21 of the flange 20, ensures a complete flow of the engineered polymer of the insulator 4 around the negative plate 2 during the molding process to encase and locate the plate 2 concentric to the ceramic cone 5.

The preferably ceramic cone 5 has an integral and concentric locking detent 27 wherein during the molding process, the engineered polymer of the insulator 4 flows into, which locks and locates the cone 5 in relation to and separated from the negative plate 2. A concentric cavity 26 in the ceramic cone 5 is formed to nestle the center or positive electrode 7.

The center electrode 7 is provided with a boss 23, stud 9 and an electrode tip 17 that is resistant to high power discharge. The boss 23 of the center electrode 7 nestles in the cavity 26 provided in the ceramic cone 5. During the manufacturing process, the cavity 26 is preferably filled with copper glass, ceramic epoxy or other suitable permanently sealing material on top of the installed center electrode 7 and boss 23 thereof, which provides a gas seal to protect the interior of the spark plug 1 from combustion pressures. The stud 9 of the electrode 7 is provided to engage the assembled positive plate of the capacitor (shown as 43 in FIG. 4) with an interference fit ensuring completion of the positive side of the ignition circuit.

Figure 3:
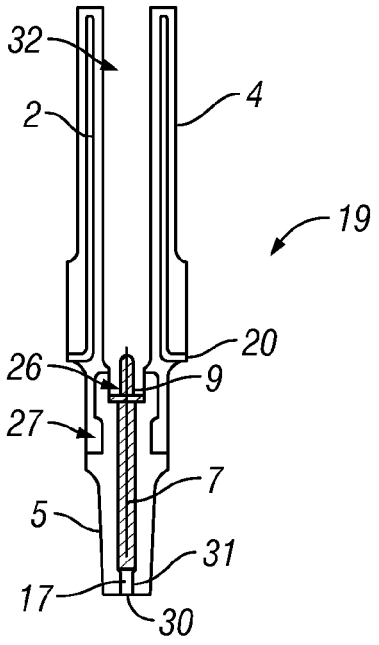
FIG. 3 is a cross sectional view of a composite insulator of the present invention.

Referring now to FIG. 3, the center electrode 7 is provided with an erosion resistant electrode tip 17 that is preferably formed from a Rhenium/Tungsten alloy of between about 50%-75% Rhenium. An end of the highly erosion resistive electrode tip 17 is preferably flush with the end 30 of the ceramic cone 5.

Within the ignition or spark gap pulsed-power industry, it is well-known that increasing the power (Watts) of the spark increases the erosion rate of the electrodes, with the spark-emanating electrode eroding faster than the receiving electrode. Industry standard has been to utilize precious or noble metals such as gold, silver, platinum and lately iridium as the electrode metal of choice to abate the electrode erosion of common ignition power. These metals, however, will not suffice to reduce the elevated electrode erosion rate of the high power discharge of the current invention. The electrode tip 17 of a sintered compound of rhenium by about 50% to 75% by mass sintered with tungsten in a preferably cylindrical configuration of 0.025"-0.060" in diameter and 0.100" in length is preferably affixed to the center electrode 7 by means of plasma, friction or electron welding or other suitable method by which permanency is achieved while delivering a low resistance juncture.

The use of pure tungsten as an electrode in a spark gap application is well documented within the pulsed-power industry as a preferred erosion resistant material. However, as used in an internal combustion engine where combustion temperatures reach beyond the oxidation temperature of tungsten, the electrode disadvantageously erodes at a faster rate than noble metals. Tungsten may be utilized as an electrode material in an automotive application by the isolation of the tungsten to the oxygen present in the combustion chamber. This is partially accomplished by the sintering of tungsten with rhenium and an appropriate binding agent such as, but not limited to, a non-oxidizing metal that melts at a temperature below that of rhenium and tungsten. The sintering process blends the two preferably powdered base metals with the binding agent and during the refractory process melts the binder and sinters the base materials into a form held together by the binder. The form, preferably rectangular in shape, is then extruded into wire of 0.025" to 0.060" in diameter to form the electrode tips 17 and 45. The bonding agent provides protection against the oxidation of the tungsten component by covering that portion of the tungsten not in contact with the rhenium.

While this offers some protection for the tungsten against oxidation, the bonding metal erodes during the high-power discharge process, exposing the raw tungsten of the electrode tips 17 and 45 to ambient oxygen in the combustion chamber and thereby accelerating tungsten erosion. However, the erosion rate due to oxygen exposure is significantly reduced by the use of the bonding agent. Additionally, as the tungsten erodes, the rhenium is now closer to the opposing or negative electrode, and as proximity and field effect dictate where the spark emanates from, the rhenium, also highly resistant to high-power erosion, becomes the source of the spark streamer.

Additionally, tungsten may be utilized as an electrode material in an automotive application by the placement of the electrode tip 17 with respect to the ceramic cone 5. In this placement, only the extreme end of the electrode tip 17 is exposed to the elements in the combustion chamber. The remainder of the cylindrical electrode tip 17 has been bonded to the ceramic cone 5, sealing off the electrode tip 17 against any combustion gasses including oxygen. In this fashion, only the extreme end of the electrode tip 17 will erode, as it will under the high power discharge of the current invention.

As the electrode tip 17 gradually wears away, electrons from the ignition pulse will emanate from the recessed electrode tip 17 and ionize the ceramic cone wall 31 and creep to the edge 30 of the ceramic cone 5 before ionizing the spark gap (not shown) and creating a spark (not shown) to the ground electrode 16. The voltage required to ionize the ceramic cone wall 31 just above the eroding electrode tip 17 is very small resulting in the total voltage required to breakdown the spark gap and create a spark being minimally more than the voltage required to break down the original, uneroded spark gap.

In this fashion, the electrode tip 17 can erode to the point where the distance from the ground electrode 16 to the center or positive electrode tip 17 has doubled, while the voltage required to break down the doubled gap is slightly more than the breakdown voltage of the original spark gap and well under the available voltage from the original equipment manufacturer ignition system. This advantageously assures proper operation of the engine for a minimum of $10^9$ cycles of the spark plug or 100,000 equivalent miles.

Referring again to FIG. 3, there is shown a molded composite insulator assembly indicated generally at 19, center electrode 7 with erosion resistant tip 17, ceramic cone 5 and binding and insulating engineered polymer 4, forming the assembly 19. Referring now to the composite insulator 19 and center electrode 7 of FIG. 3, and the center conductor 43 of FIG. 4, when the hollow center conductor 43 is inserted into the cavity 32 of the composite insulator 19, the stud 9 of the center electrode 7 engages the undersize hole 46 of the center conductor providing a highly conductive path from the ignition coil output (not shown) to the spark plug gap (not shown). Once connected to the center electrode 7, the center conductor 43 becomes the positive plate of the capacitive element and a capacitor or capacitive element, indicated generally at 28 in FIG. 5, is formed by definition, i.e.: a capacitor being two conductive plates (plates 43 and 2) of opposite electrical charge separated by a dielectric, the dielectric being the engineered polymer 4.

Figure 4:
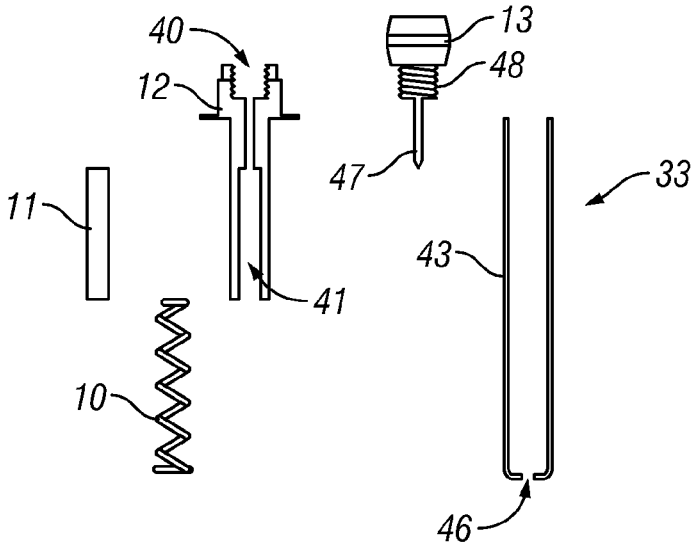
FIG. 4 is a is a partially exploded cross sectional view of the individual components comprising the positive plate of the capacitor element and the central electrode assembly.
Figure 5:
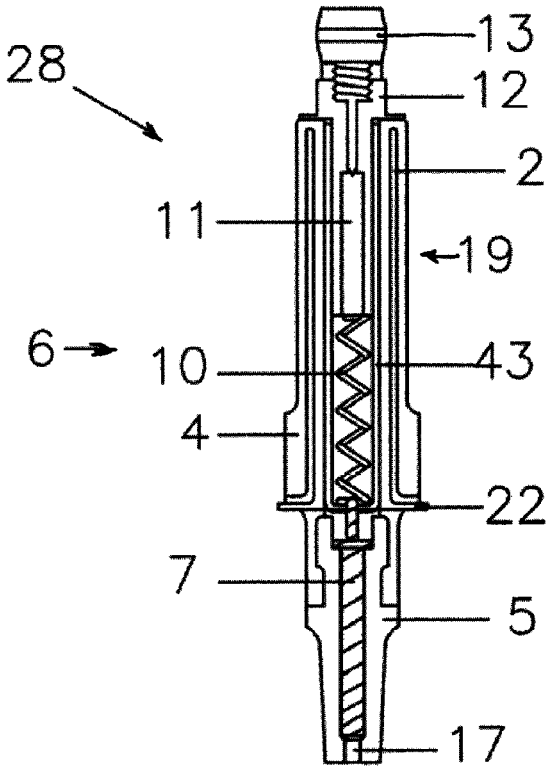
FIG. 5 is a cross sectional view of an insulator assembly of the ignition device of the present invention.

Capacitance can be mathematically arrived at by formula;

$$C = \frac{1.4122 \times D_c}{L_n(D_i / D_o)}$$

Where C is the capacitance per inch of cylindrical plates, $D_c$ is the dielectric constant of the polymer 4, $L_n$ is the natural log, $D_i$ is the inside diameter of the negative plate 2, and $D_o$ is the outside diameter of the positive plate 43 in FIG. 4. Capacitance can be increased by decreasing the separation of the oppositely charged plates 43 and 2 or by increasing the surface areas of the plates 43 and 2. Capacitance can also be affected by the dielectric constant of the engineered polymer. Dielectric constants can vary from four to over twelve depending on the material selected.

Attention is now directed in FIG. 3 to the center or positive electrode 7 and the cavity 26 of ceramic cone 5 into which the electrode 7 is embedded concentrically. Once the electrode 7 has been inserted into the ceramic cone 5, a pressure or gas seal is accomplished by completely filling the cavity 26 with ceramic epoxy, copper glass or other suitable high temperature sealant.

Referring now to FIG. 4, a center conductor assembly is indicated generally at 33 consisting of the tubular positive plate or conductor 43, resistor 11, conductive spring connector 10, terminal insert 12, and high tension cable or coil terminal 13. The resistor 11 is inserted into the cavity 41 of the terminal insert 12 and preferably retained by means of a high temperature ceramic epoxy or other high temperature adhesive suitable to retain the resistor 11 in place under operation of the engine. The high tension cable or coil terminal 13 is attached to the terminal insert 12 by means of a threaded portion 48 of the terminal 13 into the threaded cavity 40 of the terminal insert 12. The pointed shaft 47 of the terminal 13 makes physical and electrical contact with the resistor 11 once the terminal 13 is installed by screwing into the terminal insert 12. The end of the resistor 11 opposite the terminal 13 makes physical and electrical contact with the conductive spring 10, which is under compression when the center conductor assembly is inserted into the composite insulator 19 of FIG. 3.

The spring 10 end opposite the resistor 11 makes mechanical and electrical contact with the tubular positive plate or conductor 43 completing the positive circuit for the ignition pulse. The placement of the resistor 11 in the positive circuit before the positive plate 43 of the capacitive element of the spark plug 1 allows the capacitor 28 to discharge at a very high transfer efficiency rate and deposit a very high percentage, greater than 95%, of the stored energy into the fuel charge. Normally this hard deposition of energy would create an abnormal amount of radio frequency or electromagnetic interference, which is incompatible with the operation of automobile engine management computers. Placement of the resistor 11 before the capacitor 28 in the circuit allows for the deposition while elimination the interference.

Figure 6:
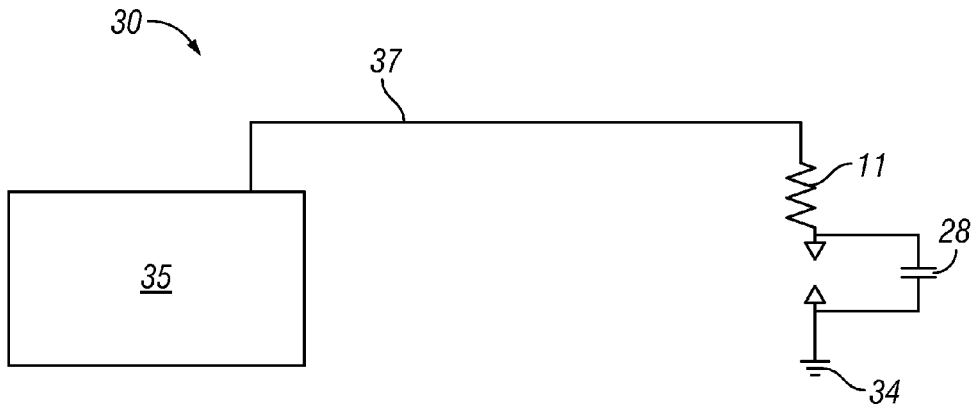
FIG. 6 is a circuit diagram for an ignition device in accordance with the present invention.

FIG. 6 illustrates an exemplary circuit 30 for the ignition device 1 of the present invention and shows a coil 35, such as an ignition coil or the like, connected to the resistor 11 through a secondary circuit 37. The capacitor 28 is connected to the resistor 11 and connected in parallel with the secondary circuit 37 and ground 34. The resistor 11 advantageously suppresses high frequency electrical noise generated by the circuit 30 while not affecting the high power discharge of the capacitor 28.

There is abundant prior experimentation with related results, see Society of Automotive Engineers Paper 02FFFL-204 titled "Automotive Ignition Transfer Efficiency", concerning the utilization of a current peaking capacitor, such as the capacitor 28 wired in parallel to the high voltage circuit such as the circuits 30 and 37 of the ignition system to increase the electrical transfer efficiency of the ignition and thereby couple more electrical energy to the fuel charge. By coupling more electrical energy to the fuel charge, consistent ignition relative to crank angle is accomplished reducing cycle-to-cycle variations in peak combustion pressure, which increases engine efficiency. An additional benefit of coupling the current peaking capacitor 28 in parallel is the resultant large robust flame kernel created at the discharge of the capacitor 28. The robust kernel causes more consistent ignition and more complete combustion, again resulting in greater engine performance. One of the benefits of utilizing a peaking capacitor 28 to improve engine performance is the ability to ignite fuel in extreme lean conditions. Today, modern engines are introducing more and more exhaust gas into the intake of the engine to reduce emissions and improve fuel economy. The use of the peaking capacitor 28 will allow automobile manufacturers to lean air:fuel ratios with additional levels of exhaust gas beyond levels of current automotive ignition capability.

Referring now to FIG. 5, there is shown the completely assembled composite insulator assembly indicated generally as 6, consisting of the over-molded insulator 19 with ceramic cone 5 and center electrode 7 with erosion resistant electrode tip 17, negative plate 2 of the capacitive element 28, and insulating engineered polymer 4. Also shown is a cross sectional view of the completely assembled component string of the center conductor assembly 33 shown in FIG. 4 consisting of the tubular positive plate or conductor 43 of the capacitor or capacitive element 28, resistor 11, conductive spring connector 10, terminal insert 12, and high tension cable or coil terminal 13. This view illustrates the completed assembly of the composite insulator assembly 6 prior to insertion and crimping into the spark plug shell 44 of FIG. 1.

Gas seal and ground contact washer 22 of FIG. 5 is placed into the shell 15 of FIG. 1, resting in the transition of diameters, ensuring the negative plate 43 makes contact with the shell 15 and completing the ground circuit of the capacitive element of the current invention.

An embodiment of the spark plug or ignition device 1 of the present invention provides a spark plug that has an insulator 4 and 5 that is a composite of dissimilar materials. An embodiment of the spark plug or ignition device 1 includes a very fine cross sectional electrode tips 17 and 45 of a material and design to effectively reduce the erosion of the electrode tips 17 and 45 prevalent in high power discharge, spark-gap devices. An embodiment of the spark plug or ignition device 1 comprises an insulator 4 constructed in such a manner as to create a capacitor 28 in parallel with the high voltage circuit 30 of the ignition system, and placement of an inductor or resistor 11 in the electrical circuit 30 of the spark plug whereby the resistor or inductor 11 suitably shields any electromagnetic or radio frequency emissions from the spark plug 1 without compromising the high power discharge of the spark. An embodiment of the spark plug or ignition device 1 also completes the capacitor 28 and high voltage circuit 30 of the ignition system to provide a path for the high power discharge to the electrode 17 of the spark plug 1.

Although the invention has been described in detail with particular reference to these preferred embodiments, other embodiments can achieve the same results. Variations and modifications of the present invention will be obvious to those skilled in the art and it is intended to cover all such modifications and equivalents. The entire disclosures of all references, applications, patents, and publications cited above and/or in the attachments, and of the corresponding application(s), are hereby incorporated by reference.

What is claimed is:

1. A composite ignition device for an internal combustion engine, comprising:

a positive electrode comprising a tip;

a coating of conductive ink bonded to said positive electrode;

a first insulator comprising a ceramic cone;

a spark gap comprising:

a J-shaped negative electrode comprising a tip;

said ceramic cone; and a terminal end of said positive electrode tip positioned flush with an end of said ceramic cone and disposed a predetermined distance from said J-shaped negative electrode;

a second insulator;

a negative capacitive element;

a positive capacitive element separated from said negative capacitive element by said second insulator, said positive capacitive element coupled to said positive electrode, said positive capacitance element and said negative capacitive element forming a capacitor, said positive capacitive element is coupled to a boss of said positive electrode by an interference fit;

a resistor disposed in a resistor insulator and disposed above said positive capacitive element by a resistor connector, said resistor disposed in a position to reduce charging current of said capacitor;

said resistor connector coupled to said positive capacitive element;

said ceramic cone having a concentric cavity formed therein;

said tip of said J-shaped negative electrode comprising an erosion reducing bonding agent;

said first insulator comprising a concentric locking detent, a portion of said second insulator disposed in said detent thus locking said first and said second insulators together; and a shell, said shell including said J-shaped negative electrode, wherein the negative capacitive element comprises at least one flange extending radially therefrom, wherein the at least one flange comprises at least one scallop to ensure a complete flow of the second insulator around the negative capacitive element.

2. The device of claim 1 wherein said negative capacitive element is embedded in said second insulator.

3. The device of claim 2 wherein said negative capacitive element is embedded in said second insulator by a manner selected from the group consisting of injection molding and insert molding.

4. The device of claim 1 wherein said second insulator comprises an engineered polymer.

5. The device of claim 4 wherein said engineered polymer comprises liquid crystal polymer.

6. The device of claim 4 wherein said engineered polymer comprises polyetheretherketone.

7. The device of claim 4 wherein said engineered polymer has a dielectric constant from between about 5 to about 10.

8. The device of claim 7 wherein said alumina material comprises from about 88 percent to about 99 percent pure alumina.

9. The device of claim 1 wherein said first insulator comprises an alumina material.

10. The device of claim 1 wherein said resistor connector comprises a spring member.

11. The device of claim 1 wherein said positive and negative electrodes comprise a sintered rhenium and tungsten material.

12. The device of claim 11 wherein said material comprises about equal parts rhenium and tungsten.

13. The device of claim 11 wherein said material comprises about three times as much rhenium as tungsten.

14. The device of claim 1 wherein said conductive ink comprises a precious metal or precious metal alloy.

15. The device of claim 1 wherein said capacitor has a predetermined capacitance in the range from about 30 to about 100 pF.

16. A circuit for an ignition device for an internal combustion engine, comprising:

a power source operable to intermittently activate said circuit;

a positive electrode comprising a tip;

a metal shell, connected to a J-shaped ground electrode;

a first insulator separating said positive electrode from said metal shell;

at least one resistor connected in series with said power source and said positive electrode;

a spark gap comprising:

a said J-shaped ground electrode, said J-shaped ground electrode comprising a tip;

a ceramic cone formed from an end of said first insulator; and a terminal end of said positive electrode tip positioned flush with an end of said ceramic cone and disposed a predetermined distance from said J-shaped ground electrode;

said tips of said J-shaped negative electrode and said positive electrode comprising an erosion reducing bonding agent; and at least one capacitor directly connected to said resistor and connected in parallel with said positive electrode and ground, said resistor not in parallel with said capacitor; said capacitor comprising a second insulator which forms a dielectric of said capacitor, said first and second insulators locked together via a detent formed on one of said insulators; and said resistor coupled to said positive electrode by a resistor connector, wherein said capacitor comprises a negative capacitive element and a positive capacitive element separated from said negative capacitive element by said second insulator, wherein the positive capacitive element is inside the negative capacitive element, wherein the negative capacitive element comprises at least one flange extending radially therefrom, wherein the at least one flange comprises at least one scallop to ensure a complete flow of the second insulator around the negative capacitive element.

17. The circuit of claim 16 wherein said at least one resistor reduces radio frequency interference (RFI) when said circuit is active.

18. The circuit of claim 16 wherein said at least one capacitor increases peak current to said spark gap when said circuit is active.

19. The circuit of claim 16 wherein at least one of said tips comprises a sintered rhenium and tungsten material.

20. The circuit of claim 19 wherein at least one of said tips comprises about equal parts of rhenium and tungsten.

21. The circuit of claim 19 wherein at least one of said tips comprises about three times as much rhenium as tungsten.

22. The circuit of claim 16 wherein said at least one resistor has a predetermined total resistance in the range from about 2 kohms to about 20 kohms.

23. The circuit of claim 16 wherein said at least one capacitor has a predetermined total capacitance in the range from about 30 to about 100 pF.

24. A composite ignition device for an internal combustion engine, comprising:

a positive electrode formed from a first electrode material having a tip formed on an end thereof, said tip formed from a material different from said first electrode material;

a boss formed on said positive electrode;

a capacitive element, said capacitive element formed from a first conductive material, a second conductive material, and an insulator disposed there between; said first conductive material coupled to said positive electrode;

a ceramic cone having a concentric cavity formed therein, said boss nestled within said cavity and a stud of said positive electrode extending beyond said ceramic cone;

said insulator and said ceramic cone locked together via a detent configuration;

a gas seal comprising a glass frit material disposed in said concentric cavity of said ceramic cone, holding said boss therein;

a spark gap comprising:

a J-shaped negative electrode comprising a tip;

said ceramic cone;

a terminal end of said tip of said positive electrode positioned flush with an end of said ceramic cone and disposed a predetermined distance from said J-shaped negative electrode; and said tips of said J-shaped negative electrode and said positive electrode comprising an erosion reducing bonding agent; and a resistor coupled to said first conductive material by a resistor connector without said resistor reducing current from said capacitor to a spark gap of said ignition device, said resistor disposed in a position to reduce charging current of said capacitor, wherein the first conductive material is inside the second conductive material, wherein the second conductive material comprises at least one flange extending radially therefrom, wherein the at least one flange comprises at least one scallop to ensure a complete flow of the insulator around the second conductive material.

25. A composite ignition device for an internal combustion engine, comprising:

a positive electrode formed from a first electrode material having a tip formed on an end thereof, said tip formed from a material different from said first electrode material;

a boss formed on said positive electrode;

a capacitive element, said capacitive element formed from a first conductive material, a second conductive material, and an insulator disposed there between; said first conductive material coupled to said positive electrode;

a ceramic cone having a concentric cavity formed therein, said boss nestled within said cavity and a stud of said positive electrode extending beyond said ceramic cone;

said insulator and said ceramic cone locked together via a detent configuration;

a spark gap comprising:

a J-shaped ground electrode comprising a tip formed thereon;

said ceramic cone; and a terminal end of said tip of said positive electrode positioned flush with an end of said ceramic cone and disposed a predetermined distance from said J-shaped ground electrode;

said tips of said J-shaped negative electrode and said positive electrode comprising an erosion reducing bonding agent;

a resistor coupled to said first conductive material by a resistor connector without said resistor reducing current from said capacitor to a spark gap of said ignition device, said resistor disposed in a position to reduce charging current of said capacitor; and said resistor connector comprising a spring member, wherein the first conductive material is inside the second conductive material, wherein the second conductive material comprises at least one flange extending radially therefrom, wherein the at least one flange comprises at least one scallop to ensure a complete flow of the insulator around the second conductive material.

* * * * *